US009395087B1

(12) United States Patent
Hsieh

(10) Patent No.: US 9,395,087 B1
(45) Date of Patent: Jul. 19, 2016

(54) THREE-IN-ONE CONVENIENT STOVE

(71) Applicant: Tze-Chen Hsieh, Thornwood, NY (US)

(72) Inventor: Tze-Chen Hsieh, Thornwood, NY (US)

( * ) Notice: Subject to any disclaimer, the term of this patent is extended or adjusted under 35 U.S.C. 154(b) by 21 days.

(21) Appl. No.: 14/667,944

(22) Filed: Mar. 25, 2015

(51) Int. Cl.

| | |
|---|---|
| ***F24C 1/00*** | (2006.01) |
| ***F24C 15/08*** | (2006.01) |
| ***F24C 3/08*** | (2006.01) |
| ***F24C 1/02*** | (2006.01) |
| ***F24C 11/00*** | (2006.01) |

(52) U.S. Cl.
CPC .. *F24C 1/02* (2013.01); *F24C 11/00* (2013.01)

(58) Field of Classification Search
None
See application file for complete search history.

(56) References Cited

U.S. PATENT DOCUMENTS

| | | | | | |
|---|---|---|---|---|---|
| 1,735,151 | A * | 11/1929 | Blaskewitz | F24C 5/20 | 126/38 |
| 2,304,302 | A * | 12/1942 | Crupi | F24C 1/02 | 219/458.1 |
| 2,658,987 | A * | 11/1953 | Ogden | F24C 1/04 | 125/36 |
| 3,230,947 | A * | 1/1966 | Finnstrand | F24C 1/02 | 126/24 |
| 3,730,672 | A * | 5/1973 | Berlincourt | F24C 3/103 | 431/264 |
| 3,802,413 | A * | 4/1974 | Pepin | F24C 1/16 | 126/25 A |
| 4,430,559 | A * | 2/1984 | Rabay | A47J 37/0676 | 126/25 R |
| 4,899,723 | A * | 2/1990 | Pajares | F24C 1/04 | 126/39 BA |
| 5,402,767 | A * | 4/1995 | Kahlke | F24C 1/02 | 126/39 D |
| 5,921,229 | A * | 7/1999 | Blake | F24C 3/14 | 126/275 R |
| 6,382,086 | B1 * | 5/2002 | Roberts | A47J 37/067 | 99/331 |
| 7,163,011 | B2 * | 1/2007 | Pestrue | A47J 37/0713 | 126/36 |
| 8,666,233 | B2 * | 3/2014 | Lee | F24C 1/02 | 392/307 |
| 2005/0205545 | A1 * | 9/2005 | Siegel | A47J 37/0623 | 219/386 |

* cited by examiner

*Primary Examiner* — Thor Campbell
(74) *Attorney, Agent, or Firm* — Jackson IPG PLLC; Demian K. Jackson

(57) ABSTRACT

A three-in-one convenient stove includes a stove body, and an electric stove, a gas stove and a gas canister stove mounted in the stove body. Thus, the user can select to use the cheaper energy source according to the volatility of natural gas and electricity prices, or select to use the electricity, the natural gas or a gas canister as an energy source when the supply of electricity and/or the supply of liquefied natural gas are interrupted.

3 Claims, 5 Drawing Sheets

THREE-IN-ONE CONVENIENT STOVE

BACKGROUND OF THE INVENTION

1. Field of the Invention

The present invention relates to kitchen stoves and more particularly, to a three-in-one convenient stoves, which has at least one electric stove, at least one gas stove and at least one gas canister stove arranged in one stove body so that the user can select to use the electric stove, the gas stove or the gas canister stove for cooking subject to cost savings or different requirements.

2. Description of the Related Art

Commercial gas stoves and electric stoves are independent cookers. A gas stove uses natural gas as a fuel source. An electric stove uses electricity as an energy source. If the supply of natural gas is interrupted of the power supply fails, the user will get famished, causing distress. Further, gas and electricity prices fluctuate so much. If a user can choose to use the cheaper energy source, it will result in substantial operational cost savings. Further, if the supply of electricity and the supply of natural are interrupted, the user will encounter the danger of getting famished.

SUMMARY OF THE INVENTION

The present invention has been accomplished under the circumstances in view. It is the main object of the present invention to provide a three-in-one convenient stove, which has at least one electric stove and at least one gas stove mounted in the stove body thereof so that when the supply of the energy source of electricity or the energy source of liquefied natural gas is interrupted, the other energy source can be used, preventing from getting famished.

It is another object of the present invention to provide a three-in-one convenient stove, which allows the user select the cheaper energy source according to the volatility of natural gas and electricity prices, saving the costs.

It is still another object of the present invention to provide a three-in-one convenient stove, which has at least one electric stove and the at least one gas stove mounted in one stove body, saving the manufacturing cost and lowering the product price, and thus a user using the three-in-one convenient stove can obtain an electric stove and a gas stove without needing not to separately purchase a gas stove and an electric stove, saving the cost and kitchen installation space.

It is still another object of the present invention to provide a three-in-one convenient stove, which allows the user to a gas canister as an energy source when the supply of electricity and the supply of liquefied natural gas are interrupted, preventing from getting famished.

DETAILED DESCRIPTION OF THE INVENTION

Figure 1:
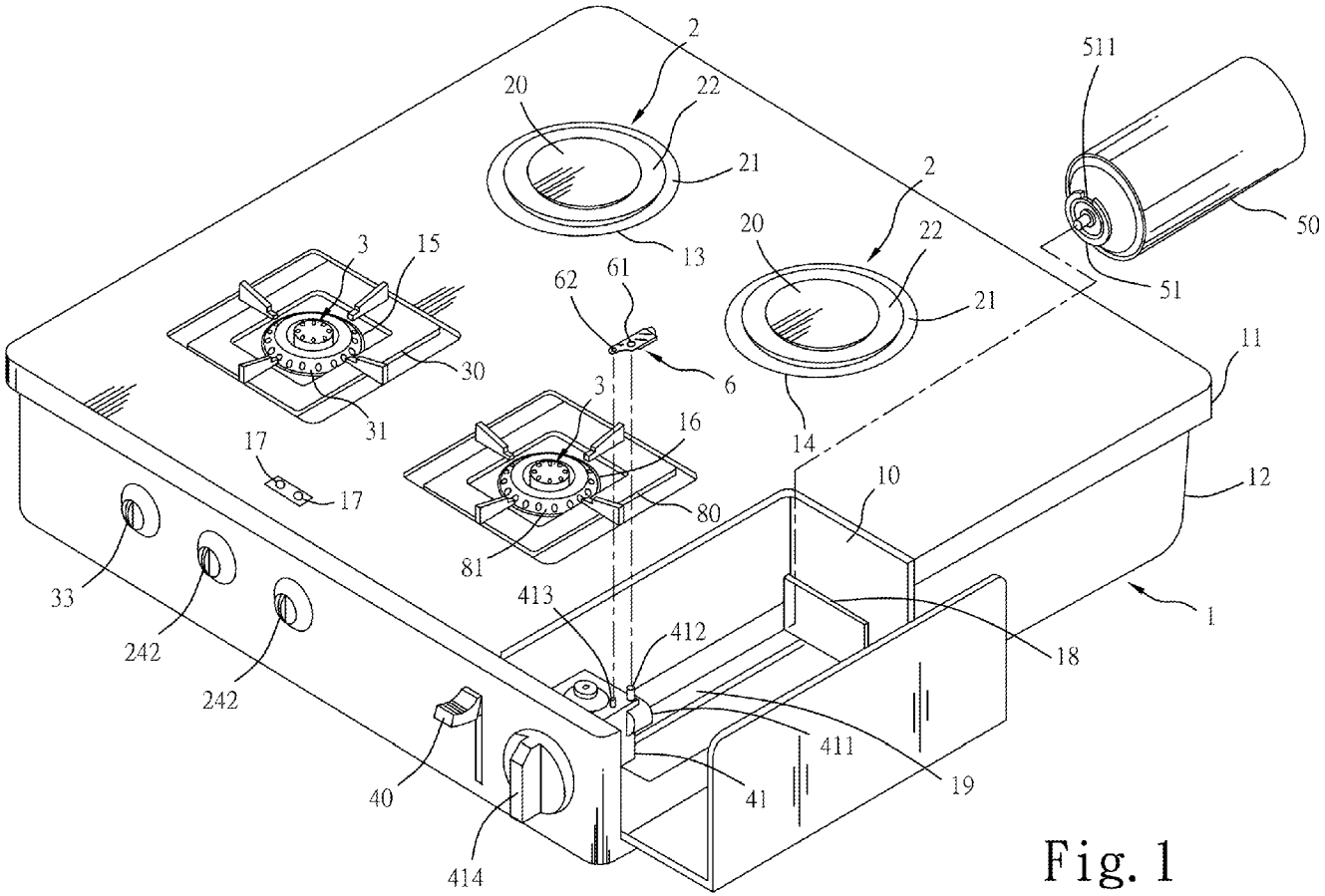
FIG. 1 is an exploded view of a three-in-one convenient stove in accordance with the present invention.
Figure 2:
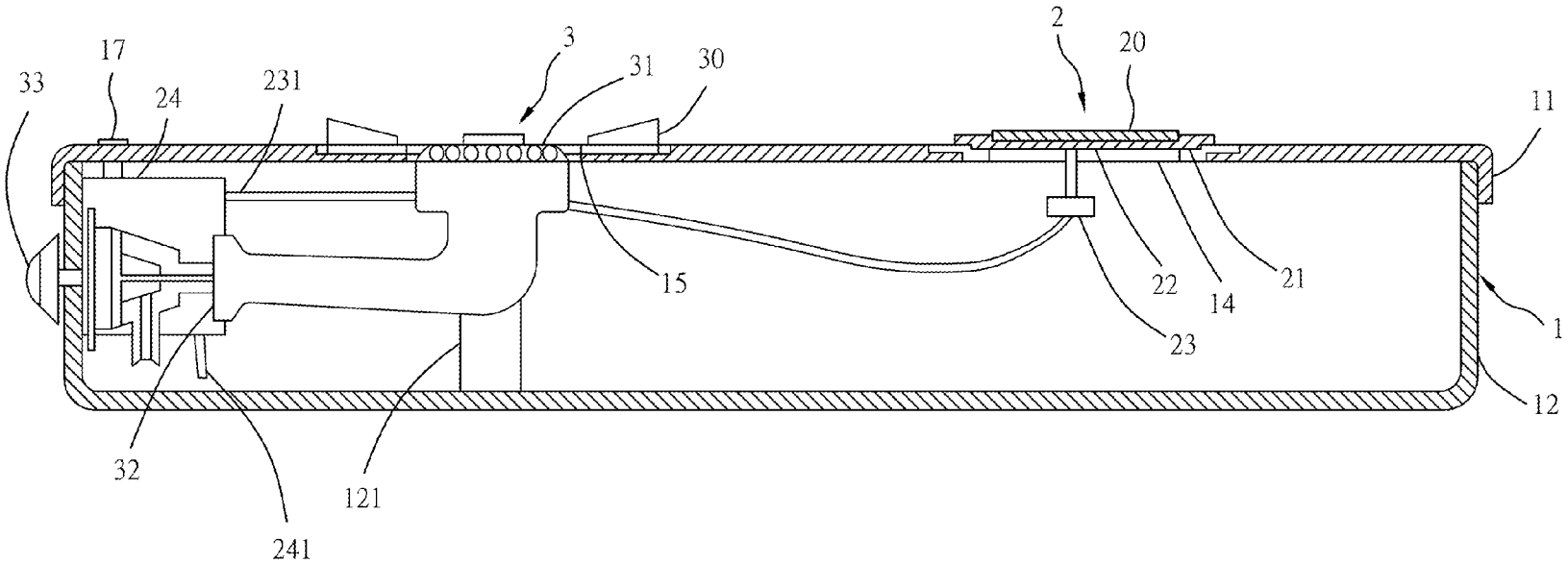
FIG. 2 is a sectional assembly view of the three-in-one convenient stove in accordance with the present invention.
Figure 3:
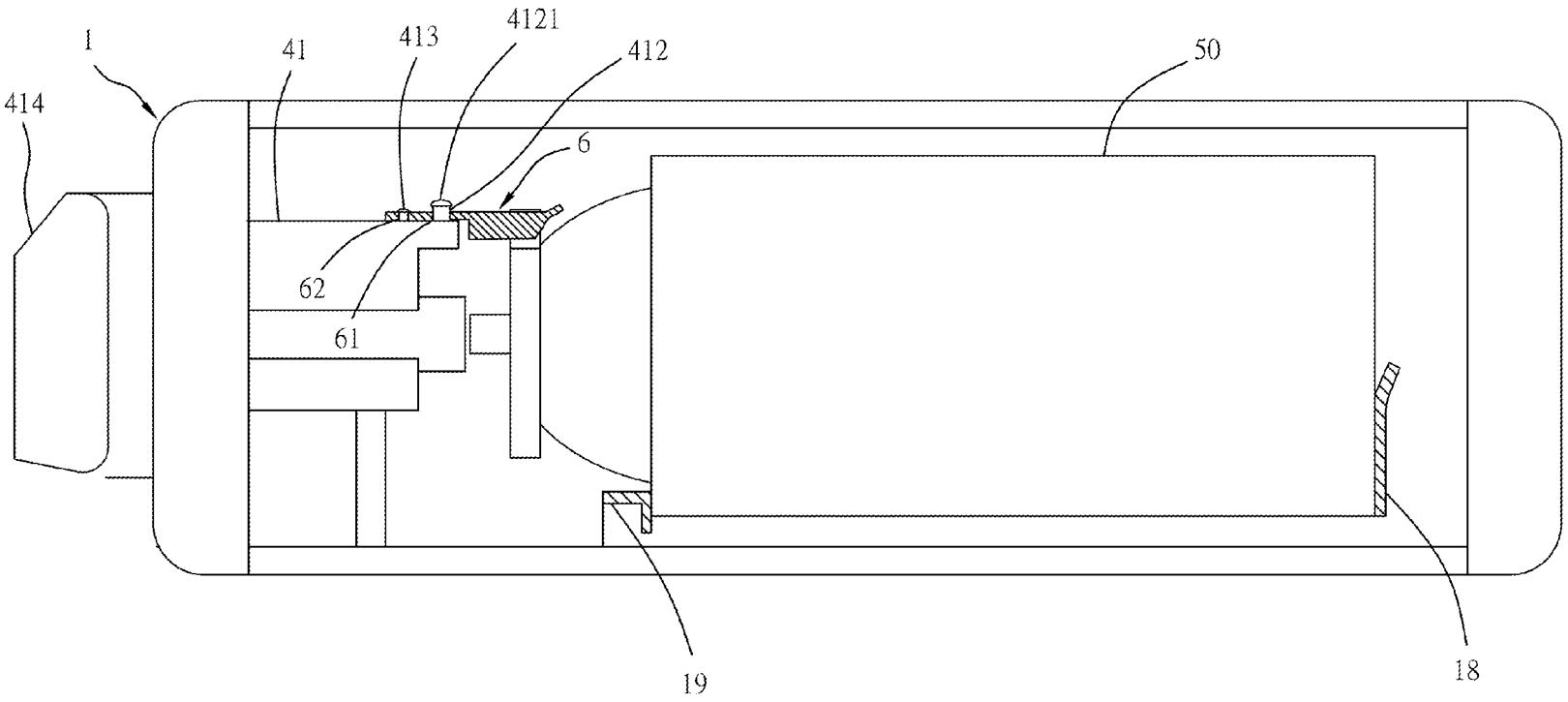
FIG. 3 is a sectional view of a part of the present invention, illustrating a gas canister loaded in the stove body before engagement with the control valve.

Referring to FIGS. 1-5, a three-in-one convenient stove in accordance with the present invention is shown. The three-in-one convenient stove comprises a stove body 1 having mounted therein at least one electric stove 2, at least one gas stove 3 and at least one gas canister stove 8. The stove body 1 comprises a top cover panel 11 and a base frame 12. The top cover panel 11 comprises a plurality of locating holes 13;14, at least one gas stove mounting hole 15, and at least one gas canister stove mounting hole 16. Each electric stove 2 comprises an insulative gasket ring 21 mounted on the top cover panel 11 of the stove body 1 around one respective locating hole 13;14, a heating element 22 mounted on the insulative gasket ring 21, an electric contact device 23 (see FIG. 2) electrically coupled with the heating element 22 and disposed inside the stove body 1, and a power control circuit 24 mounted in the base frame 12 of the stove body 1 and electrically coupled with the electric contact device 23 through an electrical wire 231. The power control circuit 24 comprises an electric power cable 241 adapted for connecting to an external power source for power input, and a power switch 242 mounted in a front side of the base frame 12 of the stove body 1 for power on/off control. Further, pot racks 30;80 are respectively mounted on the top cover panel 11 of the stove body 1 above the gas stove mounting hole 15;16. The at least one gas stove 3 is mounted in the base frame 12 of the stove body 1 corresponding to the at least one gas stove mounting hole 15, each comprising a gas burner 31 positioned in the gas stove mounting hole 15, a gas pipe 32 connected with the gas burner 31 for connection to an external fuel gas source, and a gas control switch 33 mounted in the front side of the base frame 12 of the stove body 1 for switching on/off the supply of fuel gas through the gas pipe 32. The at least one gas canister stove 8 is mounted in the base frame 12 of the stove body 1 corresponding to the at least one gas canister stove mounting hole 16, each comprising a gas burner 81 positioned in the gas canister stove mounting hole 16, a sliding carrier 19 slidably mounted in a respective gas canister chamber 10 in the stove body 1 and adapted for holding a gas canister 50 and having an upright push plate 18 located at a rear end thereof, a control valve 41 mounted in a front side of the gas canister chamber 10 and connected with the gas burner 81 through a connection tube 415 (see FIG. 5), a linkage control knob 40 vertically slidably mounted in the front side of the base frame 12 of the stove body 1 and operable to drive the push plate 18 in moving the loaded gas canister 50 forwardly into engagement with the control valve 41, and a gas canister stove control switch 414 mounted in the front side of the base frame 12 of the stove body 1 and operable to open the loaded gas canister 50. The control valve 41 comprises a port 411 for the insertion of the front end of the loaded gas canister 50, a positioning shrapnel 6 mounted at a top side thereof above the port 411 for engaging into a locating groove 511 in a front engagement portion 51 of the loaded gas canister 50 to secure the loaded gas canister 50 to the port 411 of the control valve 41 and comprising a mounting hole 62 and an insertion hole 61, a locating rod 413 disposed above the port 411 and riveted to the mounting hole 62 to affix the positioning shrapnel 6 in place, and a position-limit rod 412 disposed above the port 411 and upwardly inserted through the insertion hole 61 of the positioning shrapnel 6 to prohibit the shrapnel 6 from horizontal displacement and having an expanded top stop flange 4121 spaced above the positioning shrapnel 6 (see FIG. 3 and FIG. 6) to prevent the front end of the positioning shrapnel 6 from being excessively upwardly curved.

Figure 4:
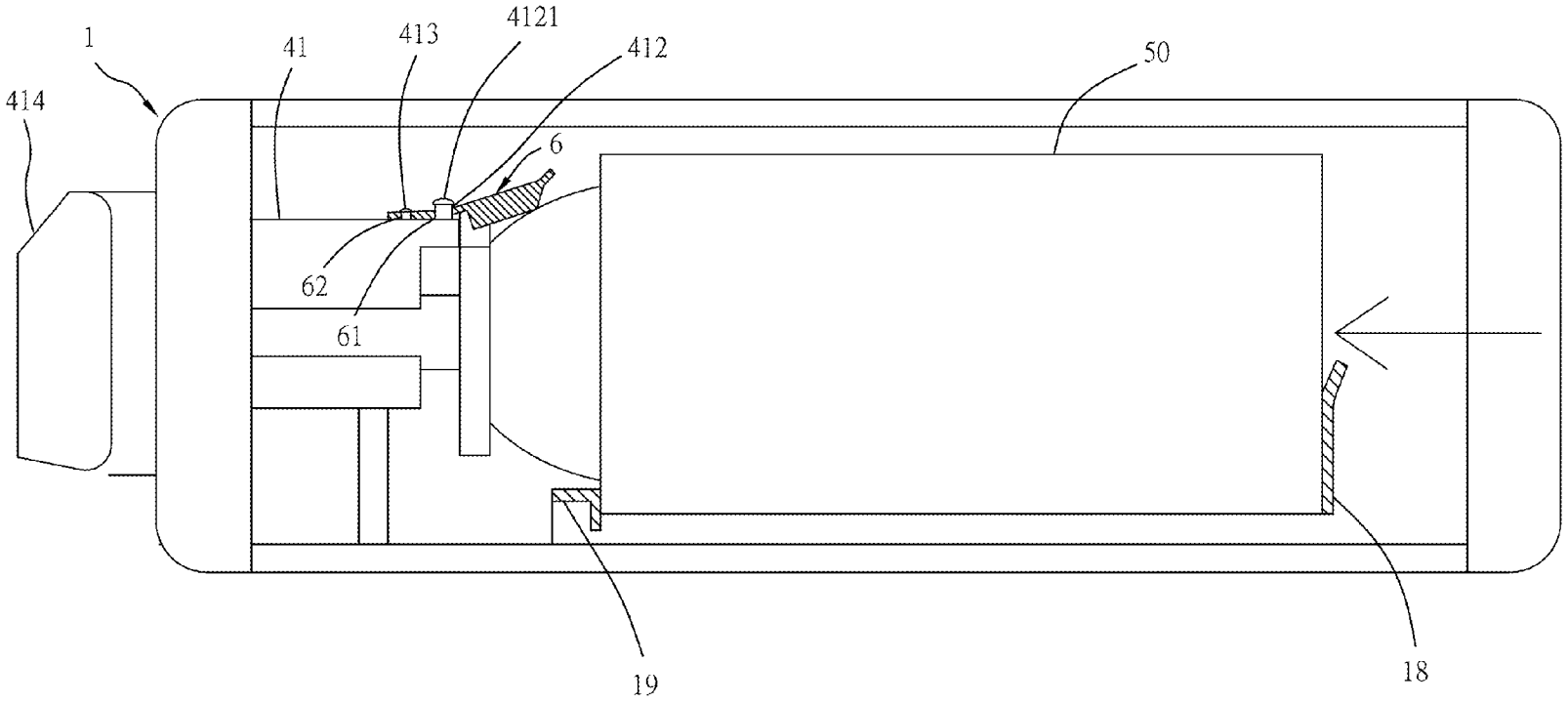
FIG. 4 corresponds to FIG. 3, illustrating the loaded gas canister engaged into the port of the control valve.
Figure 5:
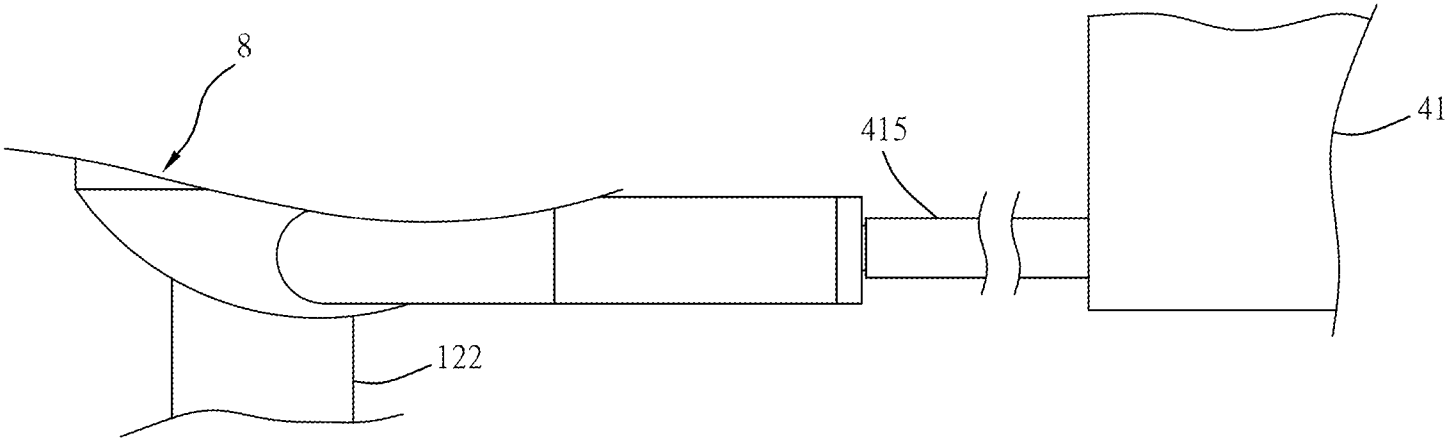
FIG. 5 is a schematic plain view, in an enlarged scale, of a part of the three-in-one convenient stove in accordance with the present invention.

As illustrated in FIG. 4, when the user presses down the linkage control knob 40, the sliding carrier 19 is driven to move the gas canister 50 forwardly into engagement with the port 411 of the control valve 41 for allow the gas canister 50 to discharge contained fuel gas into the control valve 41. At the same time, the positioning shrapnel 6 is curved upwards by the gas canister 50 and stopped against the expanded top stop flange 4121 of the position-limit rod 412, imparting a downward pressure to the gas canister 50 to hold down the gas canister 50 and to prevent a gas leakage.

Further, at least one first bracket 121 and at least one second bracket 122 are respectively provided in the base frame 12 of the stove body 1 for supporting the at least one gas stove 3 and the at least one gas canister stove 8.

Further, the aforesaid heating element 22 can be a heat coil or flat-top surface like glass-ceramic cooktop. Further, a thermal plate 20 can be mounted on the top side of the heating element 22. The thermal plate 20 can be configured to exhibit a disk-like shape or any other shape.

Further, at least one indicator light 17 is mounted in the stove body 1 and respectively electrically connected to the at least one electric stove 2. When one electric stove 2 is turned on, one respective indicator light 17 will be electrically conducted to give off light. As the arrangement of the at least one indicator light 17 is of the known art and not within the scope of the invention, no further detailed description in this regard will be necessary.

In conclusion, the invention has the features and advantages as follows:

1. The stove body 1 has at least one electric stove 2 and at least one gas stove 3 installed therein so that when the supply of the energy source of electricity or the energy source of liquefied natural gas is interrupted, the other energy source can be used, preventing from getting famished.
2. With the volatility of natural gas and electricity prices, the user can select to use the cheaper energy source, saving the costs.
3. The at least one electric stove 2 and the at least one gas stove 3 are mounted in one stove body 1, saving the manufacturing cost and lowering the product price; a user using the three-in-one convenient stove can obtain an electric stove and a gas stove without needing not to separately purchase a gas stove and an electric stove, saving the cost and kitchen installation space.
4. When the supply of electricity and the supply of liquefied natural fuel gas are interrupted, the user can use the three-in-one convenient stove with a gas canister 50 preventing from getting famished.
5. The control valve 41 provides a positioning shrapnel 6 at the top side of the port 411 for engaging into the locating groove 511 in the front engagement portion 51 of the located gas canister 50 to hold down the loaded gas canister 50 firmly in place, preventing a gas leakage and enhancing the operational safety.

What is claimed is:

1. A three-in-one convenient stove, comprising:

a stove body comprising a base frame and a top cover panel covering said base frame, said top cover panel comprising a plurality of locating holes, at least one gas stove mounting hole, at least one gas canister stove mounting hole, and a gas canister chamber;

at least one electric stove mounted in said stove body, each said electric stop comprising an insulative gasket ring mounted on said top cover panel around one respective said locating hole, a heating element mounted on said insulative gasket ring, an electric contact device electrically coupled with said heating element and disposed inside said stove body, and a power control circuit mounted in said base frame of said stove body and electrically coupled with said electric contact device through an electrical wire, said power control circuit comprising an electric power cable adapted for connecting to an external power source for power input and a power switch mounted in a front side of said base frame of said stove body for power on/off control;

a pot rack respectively mounted on said top cover panel of said stove body above each said gas stove mounting hole;

at least one gas stove mounted in said base frame of said stove body corresponding to said at least one gas stove mounting hole, each said gas stove comprising a gas burner positioned in one said gas stove mounting hole, a gas pipe connected with said gas burner for connection to an external fuel gas source, and a gas control switch mounted in said front side of said base frame of said stove body for switching on/off the supply of fuel gas through said gas pipe;

at least one gas canister stove mounted in said base frame of said stove body corresponding to said at least one gas canister stove mounting hole, each said gas canister stove comprising a gas burner positioned in one said gas canister stove mounting hole, a sliding carrier slidably mounted in said gas canister chamber in said stove body and adapted for holding a gas canister, said sliding carrier comprising an upright push plate located at a rear end thereof, a control valve mounted in a front side of said gas canister chamber and connected with said gas burner through a connection tube, a linkage control knob vertically slidably mounted in said front side of said base frame of said stove body and operable to drive said push plate in moving the loaded gas canister forwardly into engagement with said control valve, and a gas canister stove control switch mounted in said front side of said base frame of said stove body and operable to open the loaded gas canister, said control valve comprises a port for the insertion of a front end of the loaded gas canister, a positioning shrapnel mounted at a top side thereof above said port for engaging into a locating groove in a front engagement portion of the loaded gas canister to secure the loaded gas canister to said port of said control valve, said positioning shrapnel comprising a mounting hole and an insertion hole, a locating rod disposed above said port and riveted to said mounting hole to affix said positioning shrapnel in place, and a position-limit rod disposed above said port and upwardly inserted through said insertion hole of said positioning shrapnel to prohibit said positioning shrapnel from horizontal displacement, said position-limit rod comprising an expanded top stop flange spaced above said positioning shrapnel and adapted for prohibiting said positioning shrapnel from being excessively upwardly curved.

2. The three-in-one convenient stove as claimed in claim 1, wherein said stove body further comprises at least one first bracket and at least one second bracket mounted in said base frame and adapted for holding said at least one gas stove and said at least one gas canister stove.

3. The three-in-one convenient stove as claimed in claim 1, wherein each said electric stove further comprises a thermal plate located at a top side of the heating element thereof.

* * * * *